US009439823B2

(12) United States Patent
Tilk et al.

(10) Patent No.: US 9,439,823 B2
(45) Date of Patent: Sep. 13, 2016

(54) PATIENT TRANSFER DEVICE

(71) Applicant: Nottingham Spirk Design Associates, Cleveland, OH (US)

(72) Inventors: Jason Tilk, Cleveland Heights, OH (US); William Rabbitt, Chesterland, OH (US); Rebecca Blice, Akron, OH (US)

(73) Assignee: Nottingham Spirk Design Associates, Cleveland, OH (US)

( * ) Notice: Subject to any disclaimer, the term of this patent is extended or adjusted under 35 U.S.C. 154(b) by 0 days.

(21) Appl. No.: 14/611,489

(22) Filed: Feb. 2, 2015

(65) Prior Publication Data

US 2016/0089289 A1 Mar. 31, 2016

Related U.S. Application Data

(63) Continuation of application No. 14/611,512, filed on Feb. 2, 2015.

(60) Provisional application No. 62/057,208, filed on Sep. 29, 2014.

(51) Int. Cl.
*A61G 7/10* (2006.01)

(52) U.S. Cl.
CPC ..... *A61G 7/1026* (2013.01); *A61G 7/1046* (2013.01)

(58) Field of Classification Search
CPC ..... A61G 1/0287; A61G 7/1025; A61G 7/1026; A61G 7/103; A61G 7/1032; A61G 7/1046; A61G 7/1063; A61G 7/1078
See application file for complete search history.

(56) References Cited

U.S. PATENT DOCUMENTS 3,341,246 A * 9/1967 Lavallee ..... 296/20
5,737,781 A 4/1998 Votel
5,890,238 A 4/1999 Votel
D435,493 S 12/2000 Jewell et al.
6,341,393 B1 1/2002 Votel
6,378,148 B1 * 4/2002 Votel ..... A61G 7/1019 5/81.1 HS
6,834,402 B2 12/2004 Hanson et al.
7,114,203 B2 10/2006 Lloyd et al.
7,458,113 B2 12/2008 Milam
7,506,387 B1 3/2009 Scordato et al.
7,571,498 B2 8/2009 Jewell et al.
2003/0074732 A1 * 4/2003 Hanson et al. ..... 5/81.1 R
2005/0150045 A1 * 7/2005 Lloyd et al. ..... 5/81.1 HS
2010/0235986 A1 9/2010 Klyne et al.
2013/0025048 A1 1/2013 Pruett

FOREIGN PATENT DOCUMENTS

EP 2 415 444 2/2012

OTHER PUBLICATIONS

AirPal Lateral Patient Transfer Device Product Brief; May 28, 2014.
HoverMatt Air Transfer System User Manual; Jun. 2013.
Stryker Glide Lateral Air Transfer System Spec Sheet; 2009 (see Note 1 on p. 1 of IDS).
EZ Matt Air Assisted Lateral Transfers; Jan. 17, 2005.
Liftaem Lateral Patient Transfer Device; Jul. 9, 2014.
Sally Tube Single Patient Use Slide Tubes Brochure (see Note 1 on p. 1 of IDS).
The Pink Slip Slide Sheet, Product Information (see Note 1 on p. 1 of IDS).
Ayala, Heidi, et al., "Minimizing Collateral Damage: Reducing the Risks Associated with Patient Handling"; Air-Assisted Lateral Patient Transfer; Jan. 2010.
TotalCare Bariatric Plus Hospital Bed Brochure; Aug. 8 2013.
Camtec Care Chair Manual; Apr. 3, 20016.
"Health and Economic Benefits of Improving Mobility for the Bedridden Patient at Home"; Next Health Inc., AgileLife Patient Transfer System; May 2011.

* cited by examiner

*Primary Examiner* — Nicholas Polito
(74) *Attorney, Agent, or Firm* — Renner, Otto, Boisselle & Sklar, LLP.

(57) ABSTRACT

A patient transfer device for transferring a patient resting on a sheet from a first resting device to a second resting device.

20 Claims, 18 Drawing Sheets

PATIENT TRANSFER DEVICE

FIELD OF THE INVENTION

The present disclosure relates generally to the field of medical devices. In particular, the present disclosure relates to a patient transfer device.

BACKGROUND

According to the recent data from the United States Bureau of Labor Statistics, health care workers suffer injuries and illnesses at nearly twice the national average rate. Hospitals had an incidence rate of 6.8 nonfatal occupational injuries and illnesses per 100 full-time workers in 2011, compared with 3.5 per 100 in all U.S. industries combined. Nearly 50 percent of the reported injuries and illnesses among nurses and nursing support staff in 2011 were musculoskeletal disorders. Nursing assistants suffered more of these disorders in 2011 than any other occupation, while registered nurses ranked fifth.

A significant part of the problem is that health care workers at hospitals, nursing homes, and home care programs face the challenge of moving partly or completely incapacitated patients. A typical patient weighs between 100 and 200 pounds, although many others weigh more. Consequently, moving a patient often requires two, three or even four health care workers. Current healthcare guidelines typically recommend that four health care workers participate in a patient transfer. These activities often create unacceptable risks of injury regardless of the number of health care workers involved in the patient transfer. The risks are even higher when a sufficient number of workers is not available to assist in a patient transfer. The costs of these injuries are significant. For example, injuries to workers' backs account for approximately 50% of worker's compensation costs for work place injuries in the health care industry in the U.S. Thus, back injuries to health care workers are a particularly vexing problem.

Patient transfer devices have been proposed to deal with the problem. Prior art devices, however, have shortcomings. The devices proposed in U.S. Pat. Nos. 6,378,148 and 6,834,402, for example, have bases that are generally too big and protrude forward too far. Therefore, the devices cannot be wheeled close enough to the resting devices to be effective. Other devices are designed to pull at locations on a sheet on which the patient rests. In some of these devices, however, the sheet, pulled at discrete locations, may wrinkle up and slide out from under the patient providing ineffective patient transfer. In yet other devices, slack on the belts or straps that pull on the sheet causes the motor or driving mechanism to "jerk" the patient when picking up the slack, which may be uncomfortable. Also, having to wait for the slack to be taken up increases the time that it takes to transfer the patient because taking up the slack increases the time for actual patient transfer to begin.

SUMMARY OF THE INVENTION

The invention relates to devices and systems which assist in moving patients who are partly or completely incapacitated. The invention more particularly relates to devices and systems which give a single health care worker the capability of moving a patient from one bed to another bed or between a bed and a cart or gurney or of repositioning the patient within a bed.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1A:
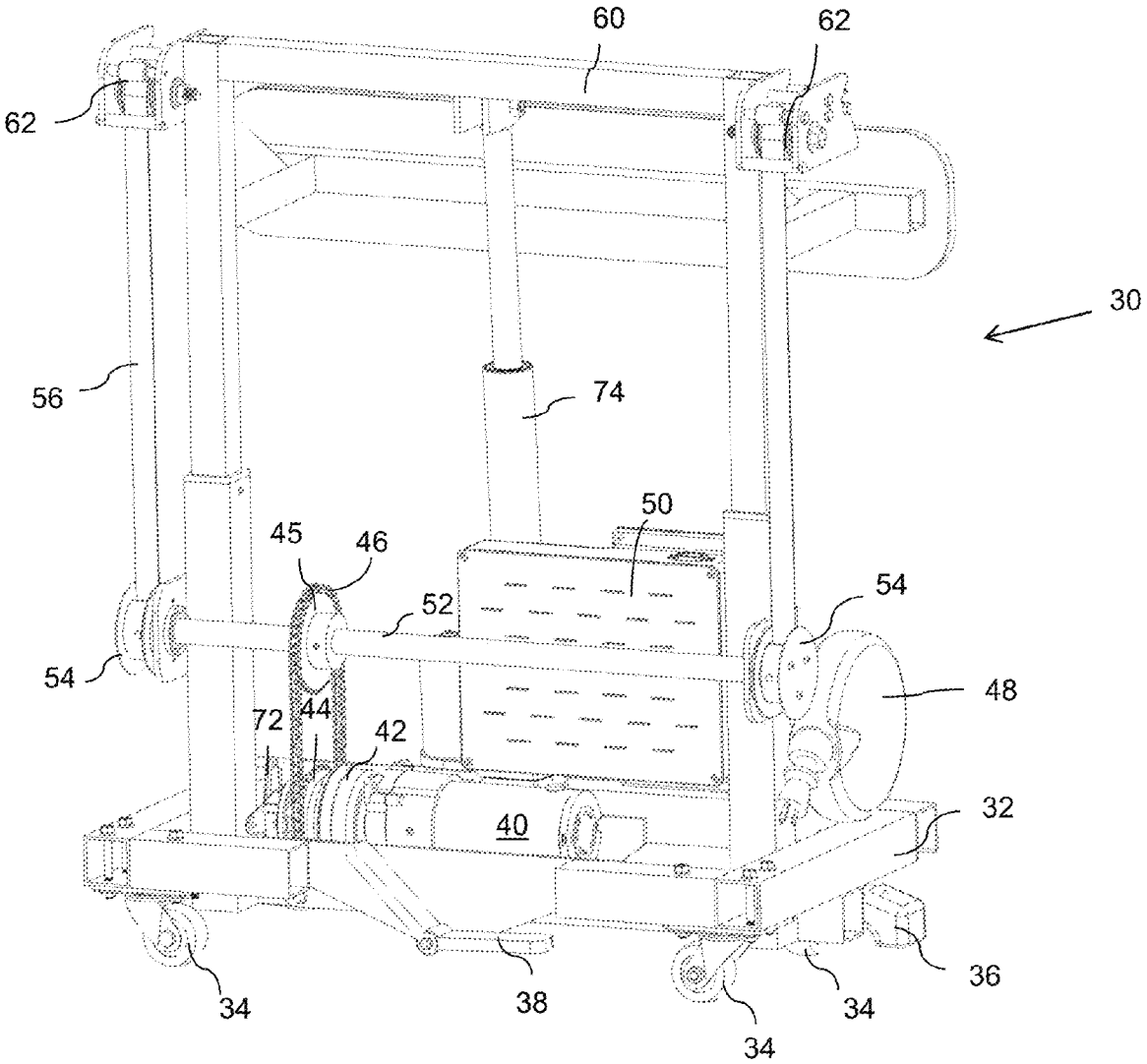
FIGS. 1A-1M illustrate various views of an exemplary patient transfer device.
Figure 1B:
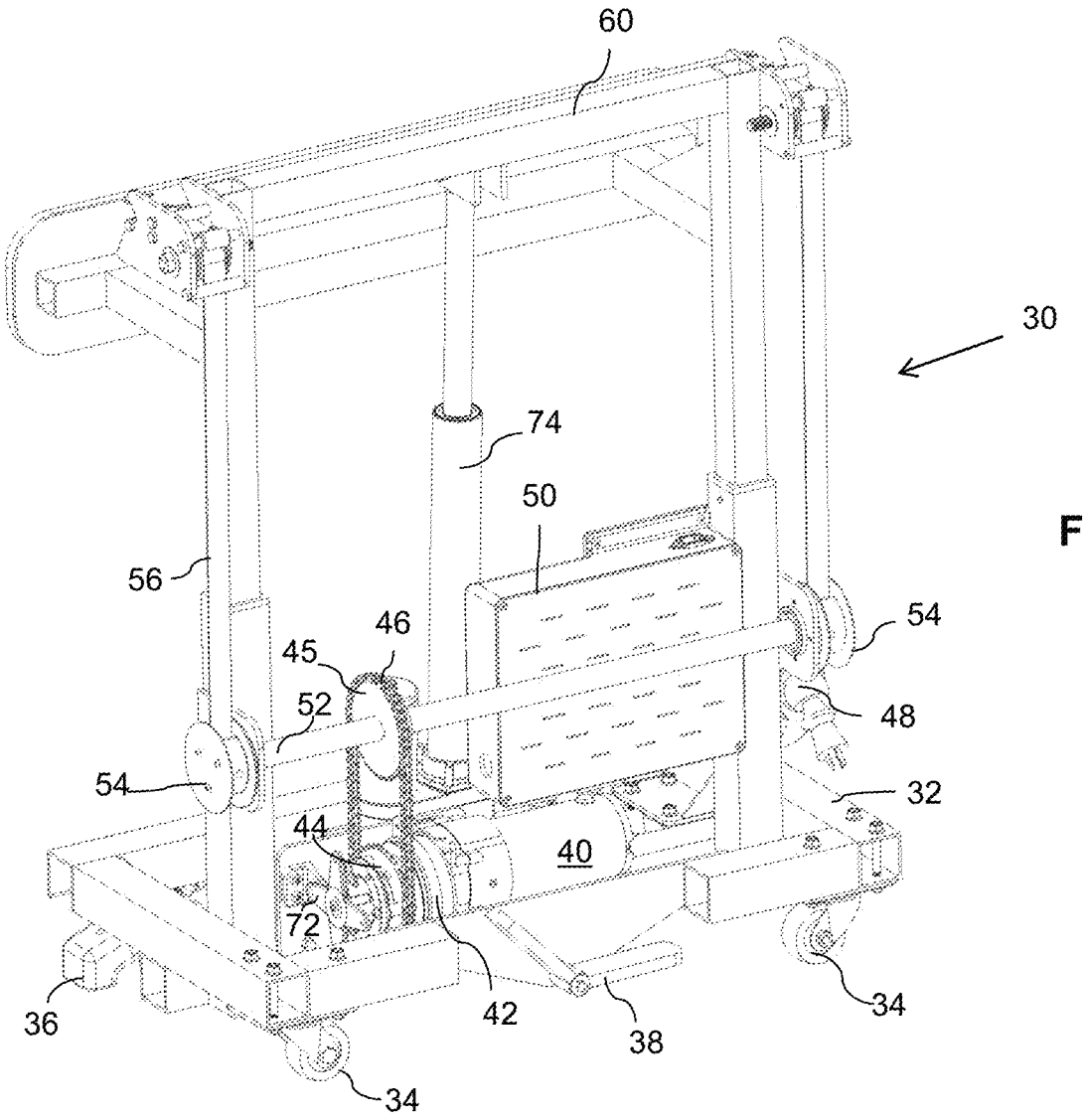
Figure 1C:
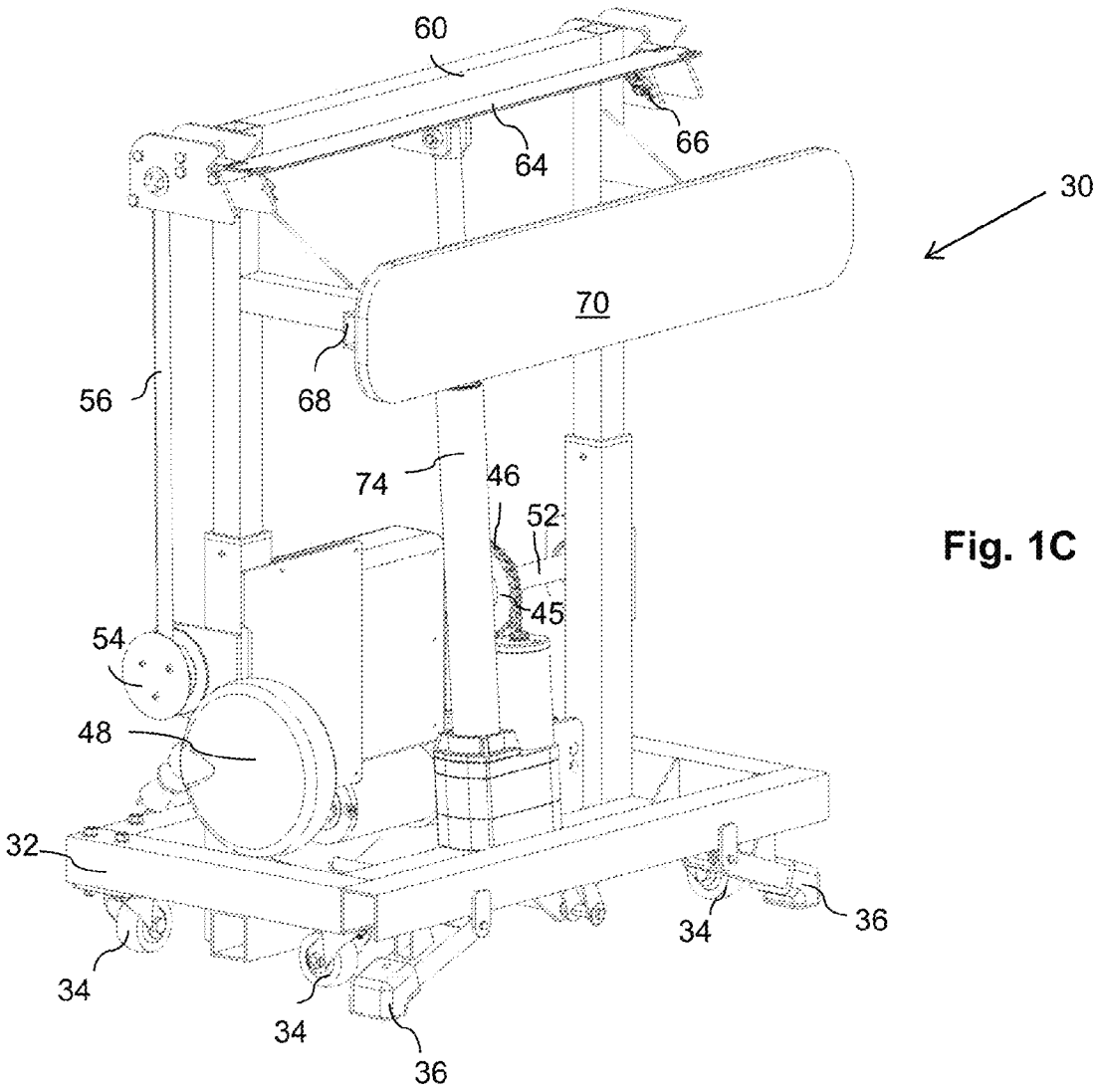
Figure 1D:
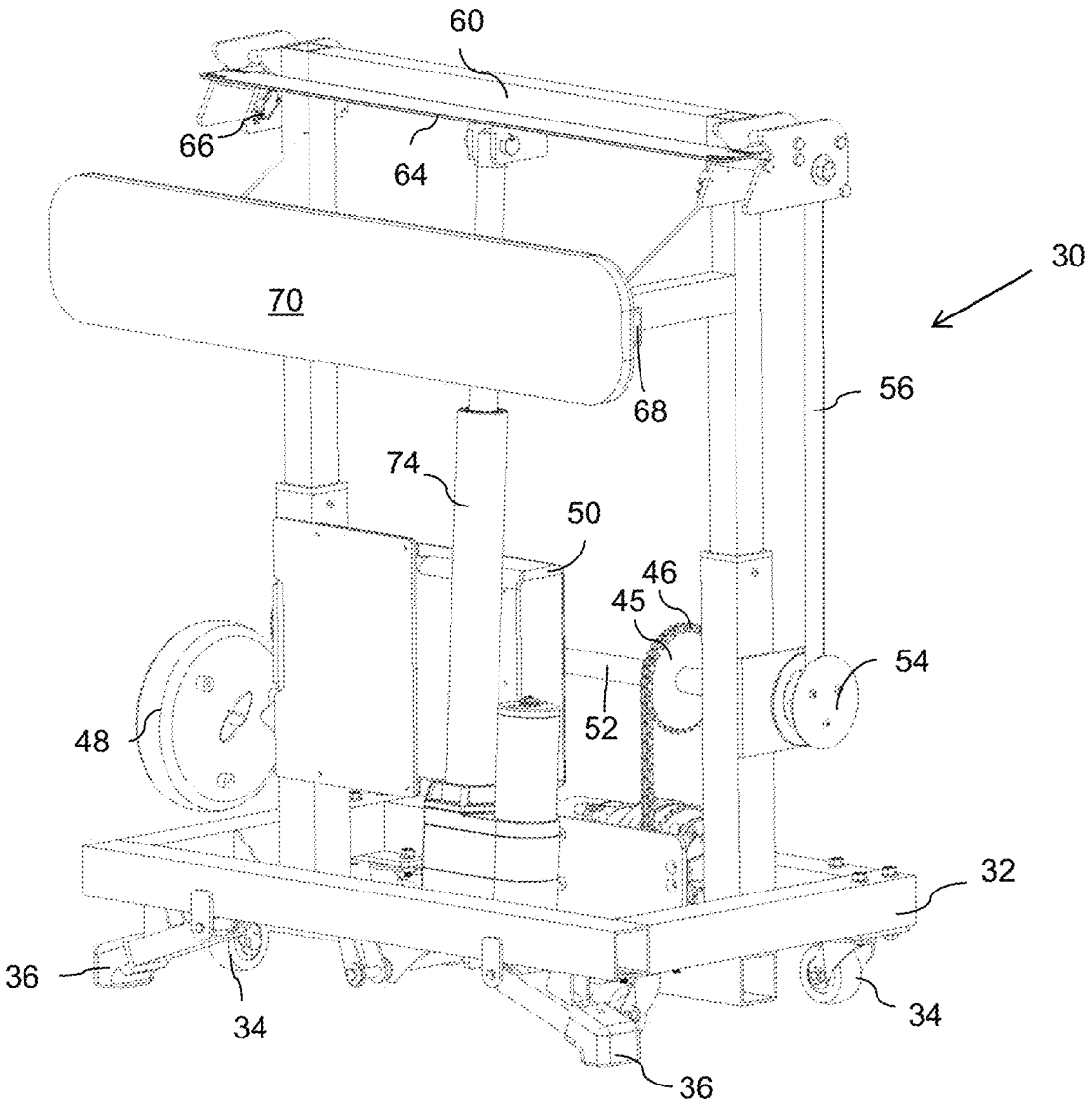
Figure 1E:
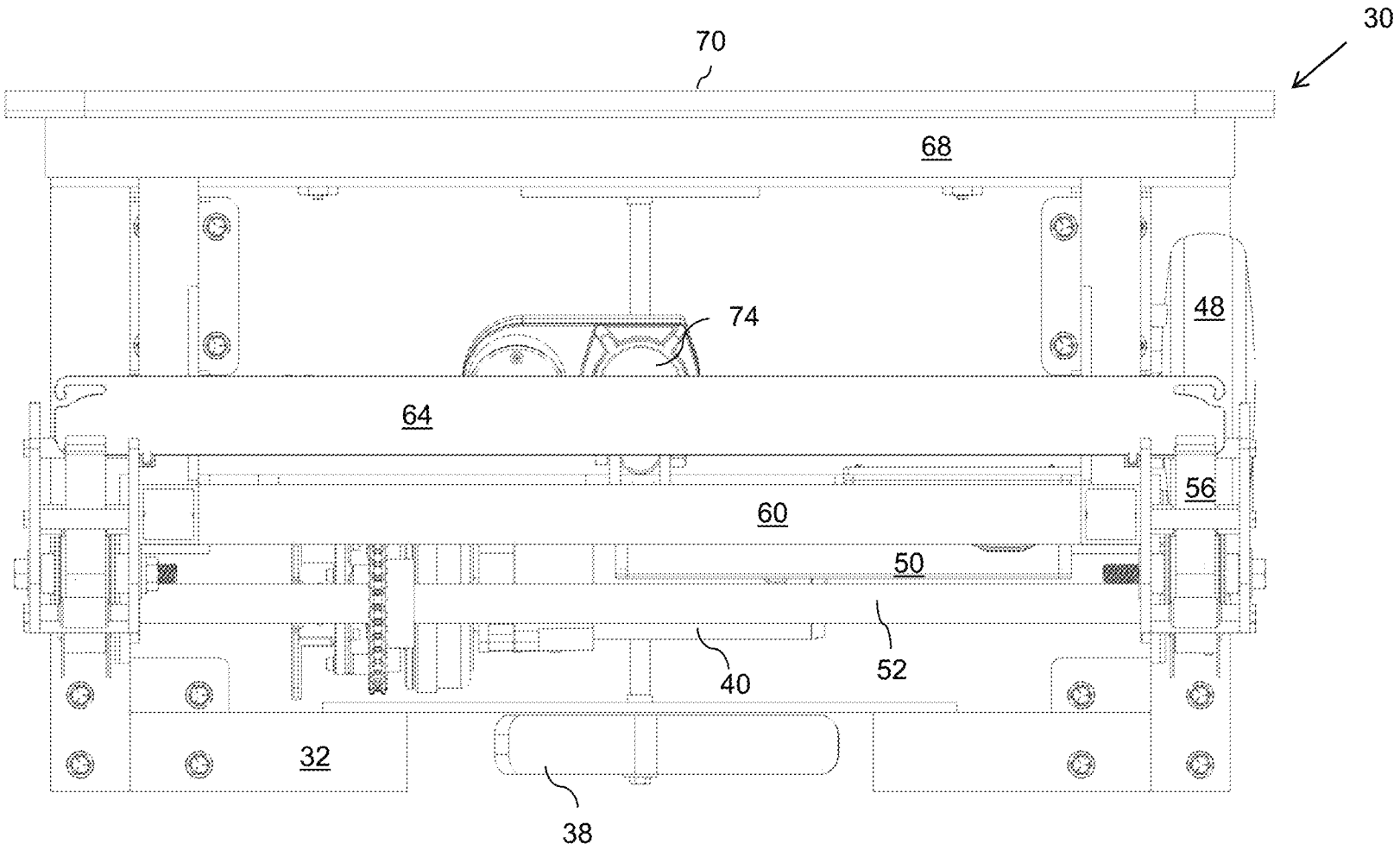
Figure 1F:
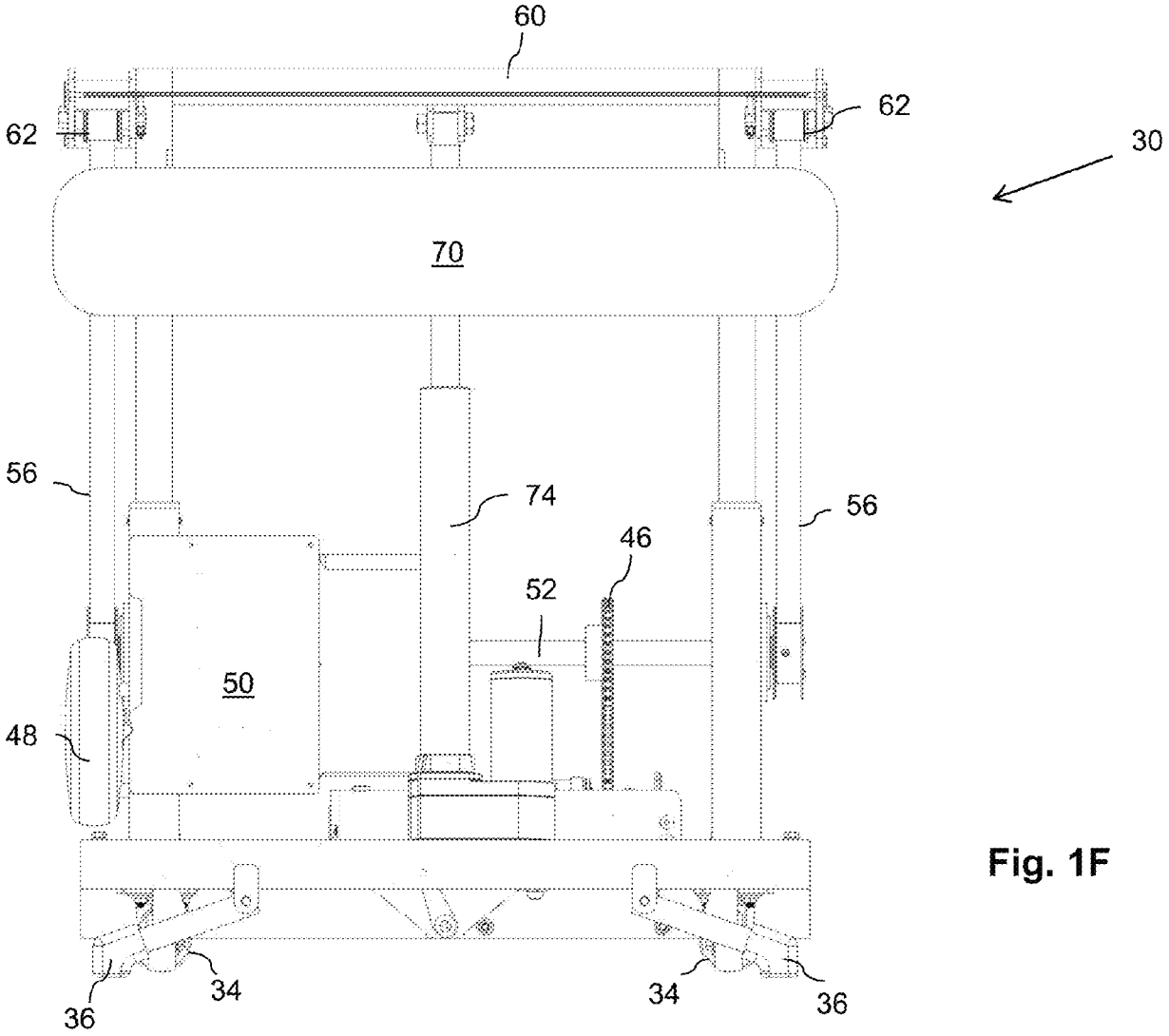
Figure 1G:
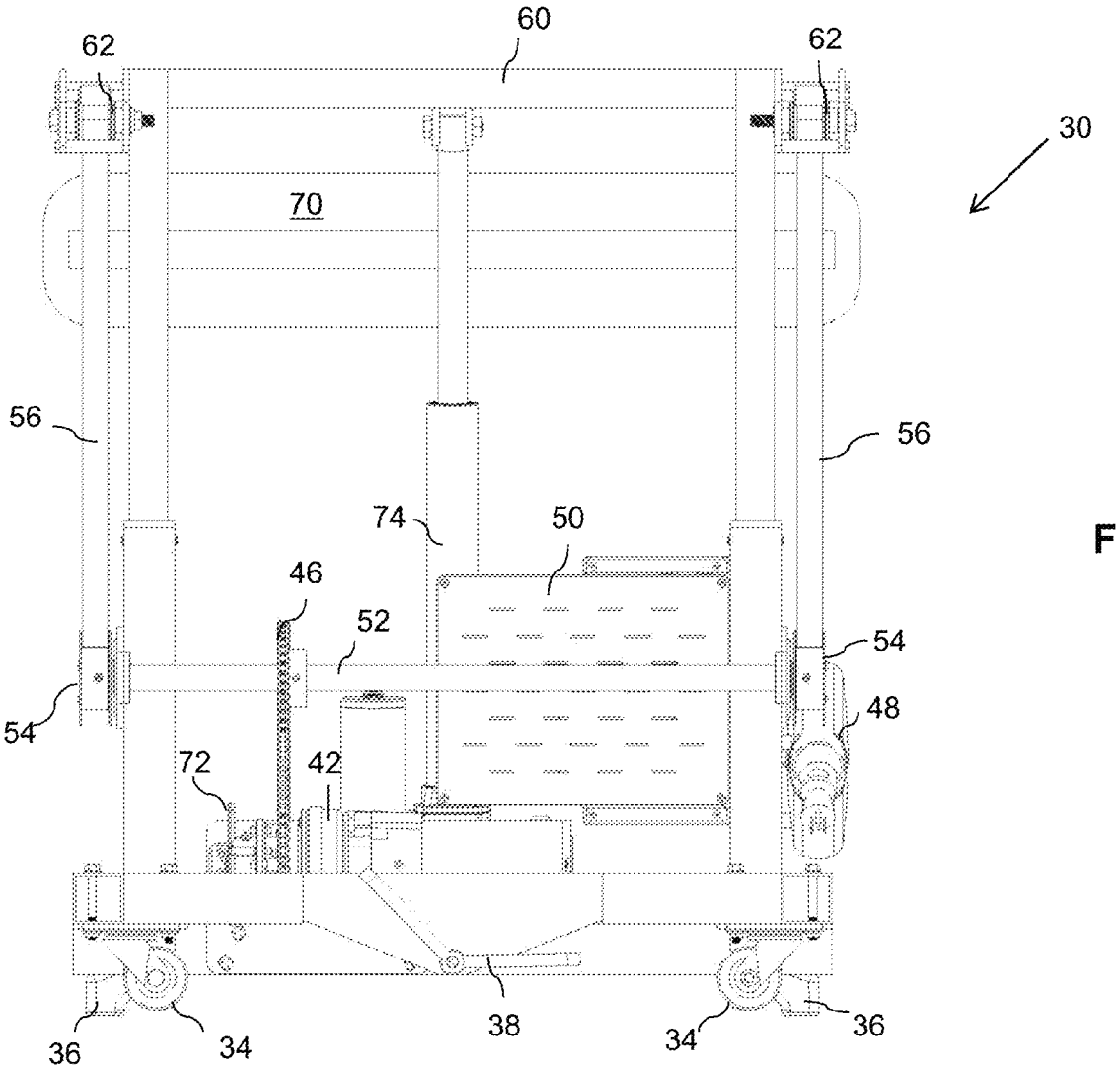

FIGS. 1A-1M illustrate various views of an exemplary patient transfer device 30. As shown in FIGS. 2A-2D, the patient transfer device 30 can be used to transfer a patient P from a first resting device D1 to a second resting device D2.

In reference to FIGS. 1A-1H, the device 30 includes a bottom assembly 32 disposed at a bottom portion of the patient transfer device 30. The bottom assembly 32 includes wheels or casters 34 for transporting or wheeling the patient transfer device 30 throughout, for example, a medical facility. In the illustrated embodiment, the device 30 includes friction locking elements 36 that extend from the bottom of the bottom assembly 32. The friction locking elements 36 include respective high friction surfaces that, when in contact with a floor, lock the device 30 to the floor by means of friction. The device 30 also includes a locking pedal 38 operatively connected to the friction locking elements 36 such that operation of the locking pedal 38 causes the friction locking elements 36 to contact the floor upon which the patient transfer device 30 rests thereby effectively locking the patient transfer device 30 to the floor. In other embodiments, in the device 30, instead of or in addition to the friction locking elements 36 and the locking pedal 38, the wheels or casters 34 may be lockable to lock the device 30 in place.

The device 30 also includes a motor 40 disposed at or adjacent the bottom assembly 32. The motor 40, a relatively heavy component of the device 30, being located at the bottom portion of the patient transfer device 30 tends to give the device 30 a low center of gravity and, thus, some measure of stability, particularly as compared to some prior art devices that may be top heavy and thus not nearly as stable. The motor 40 may be an electric reversible motor.

The motor 40 may be supplied 115 volt A/C power input via a power cord 48 which can be connected to a conventional electrical outlet. In the illustrated embodiment, the power cord 48 is retractable. The 115 volt A/C input maybe converted or otherwise controlled by circuitry (not shown) in an electrical box 50, which may include solenoids, relays, switches, etc. The motor 40 may have an output shaft (not shown) that is connected to a power transfer mechanism that may include gearing (not shown) and a clutch 42. The clutch 42 is connected to a toothed drive gear 44, which is in turn connected to another toothed drive gear 45 by a belt or chain 46.

The power transfer mechanism further includes a power transfer rod 52 connected to reels 54. The reels 54 have wound therein webbing, straps or belts 56. Hereinafter we will refer to the belts 56 as belts. However, the belts 56 may correspond to webbing, an elastomeric belt, a leather belt, a steel reinforced belt, a chain, a rope or similar device.

Figure 3:
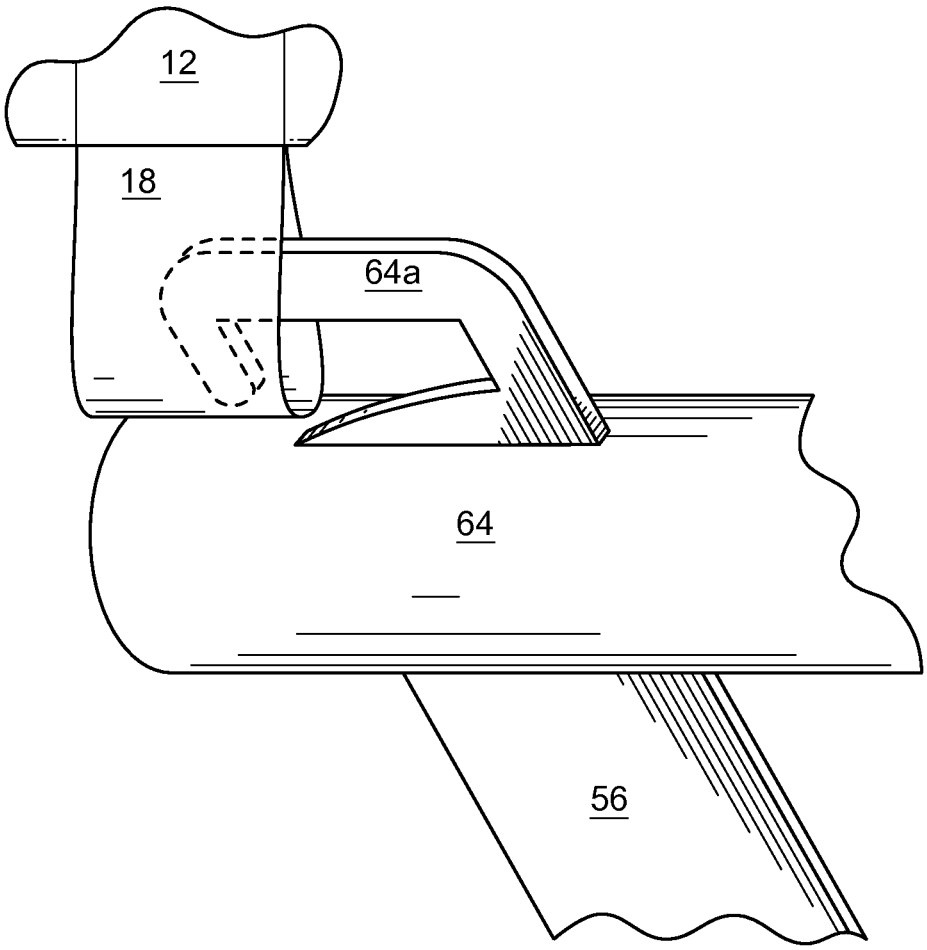
FIG. 3 illustrates exemplary engagement of a transfer sheet by the patient transfer device.

The device 30 also includes a top assembly 60 disposed at a top portion of the patient transfer device 30. The top assembly 60 includes pulleys 62 or similar force-transferring devices. The reels 54 each has at least some portion of the belts 56 wound therein and some portion of the belts 56 extends through the pulleys 62. The belts 56 ultimately connect to a sheet engaging mechanism that includes a power transfer bar 64. As best shown in FIG. 3, the power transfer bar 64 connects to the belts 56 and may include hooks 64*a* or some other fastener to connect to the sheet 12 or a fastener 10 of the sheet 12.

A problem in the prior art was that, in some patient transfer devices, the sheet was pulled at discrete locations that tended to move towards each other when pulled. The sheet clustered at a central location and slid off from under the patient providing ineffective patient transfer. The power transfer bar 64 including the fasteners 64*a* that engage the sheet 12 proximate the power transfer bar 64 prevents the pulling locations of the sheet from moving towards each other when pulled. In one embodiment, the power transfer bar 64 is at least as long as the distance between two of the pulleys 62. In another embodiment, the power transfer bar 64 is at least as long as half the length of a resting device from which the patient is being transferred. In one embodiment, the power transfer bar 64 is between 24 and 48 inches inclusive. In another embodiment, the power transfer bar 64 is shorter than 24 inches or longer than 48 inches.

Figure 1H:
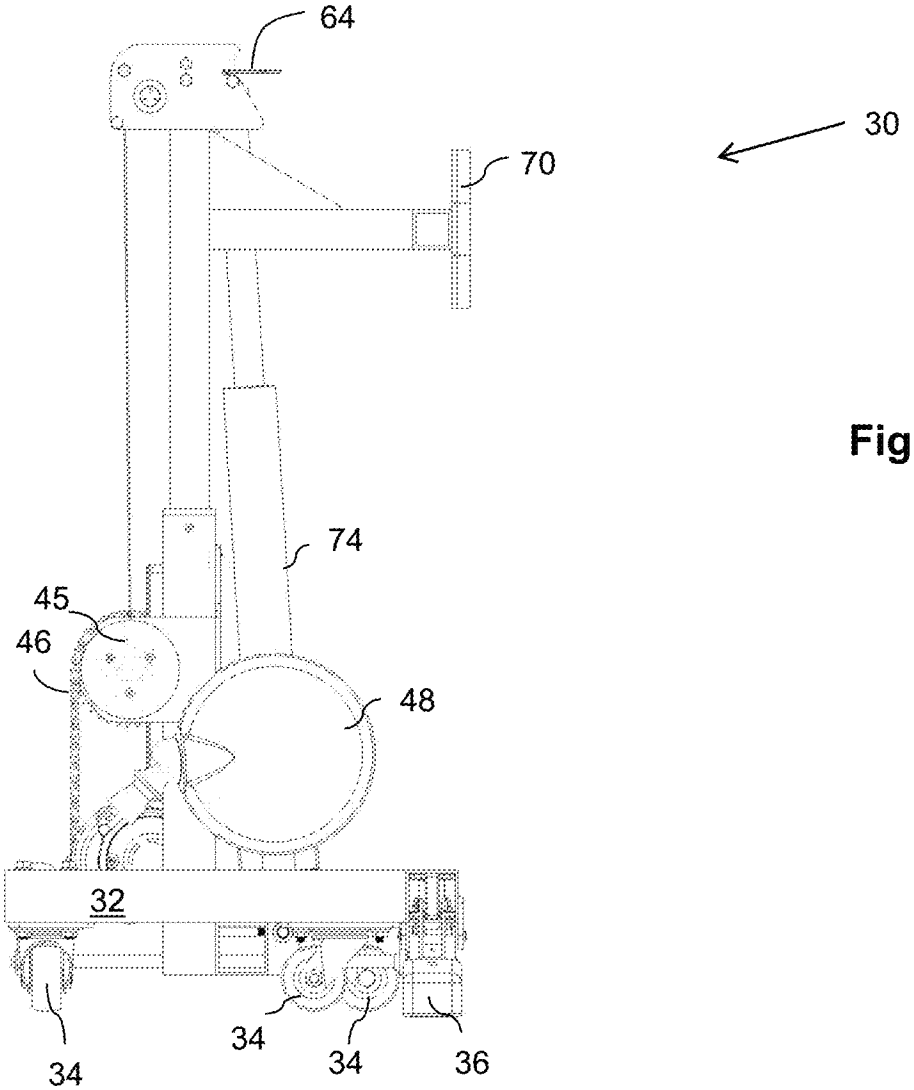
Figure 1I:
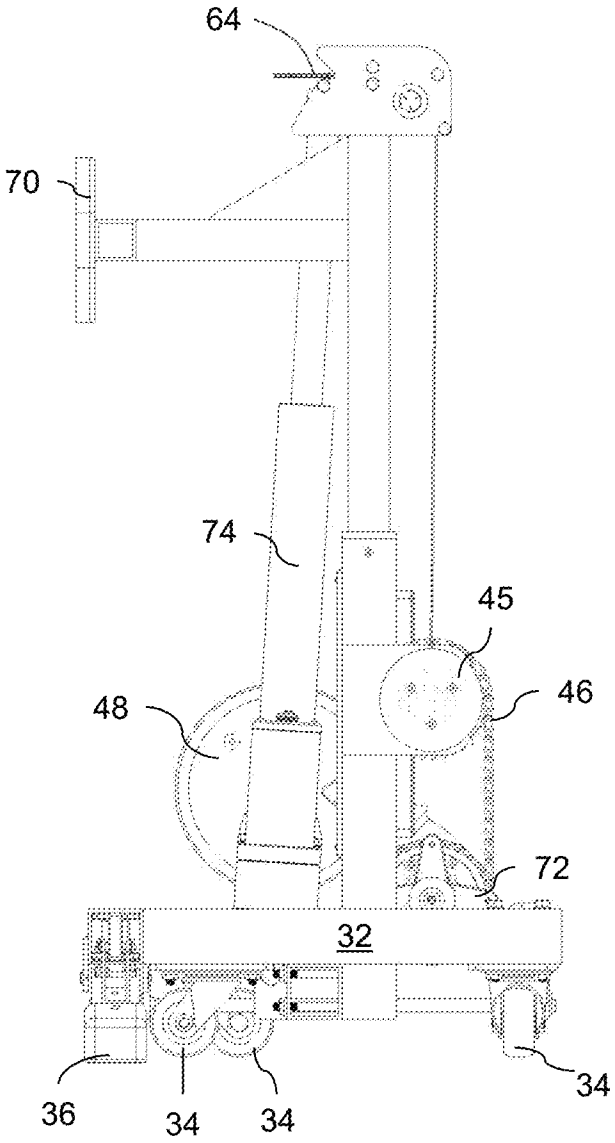
Figure 1J:
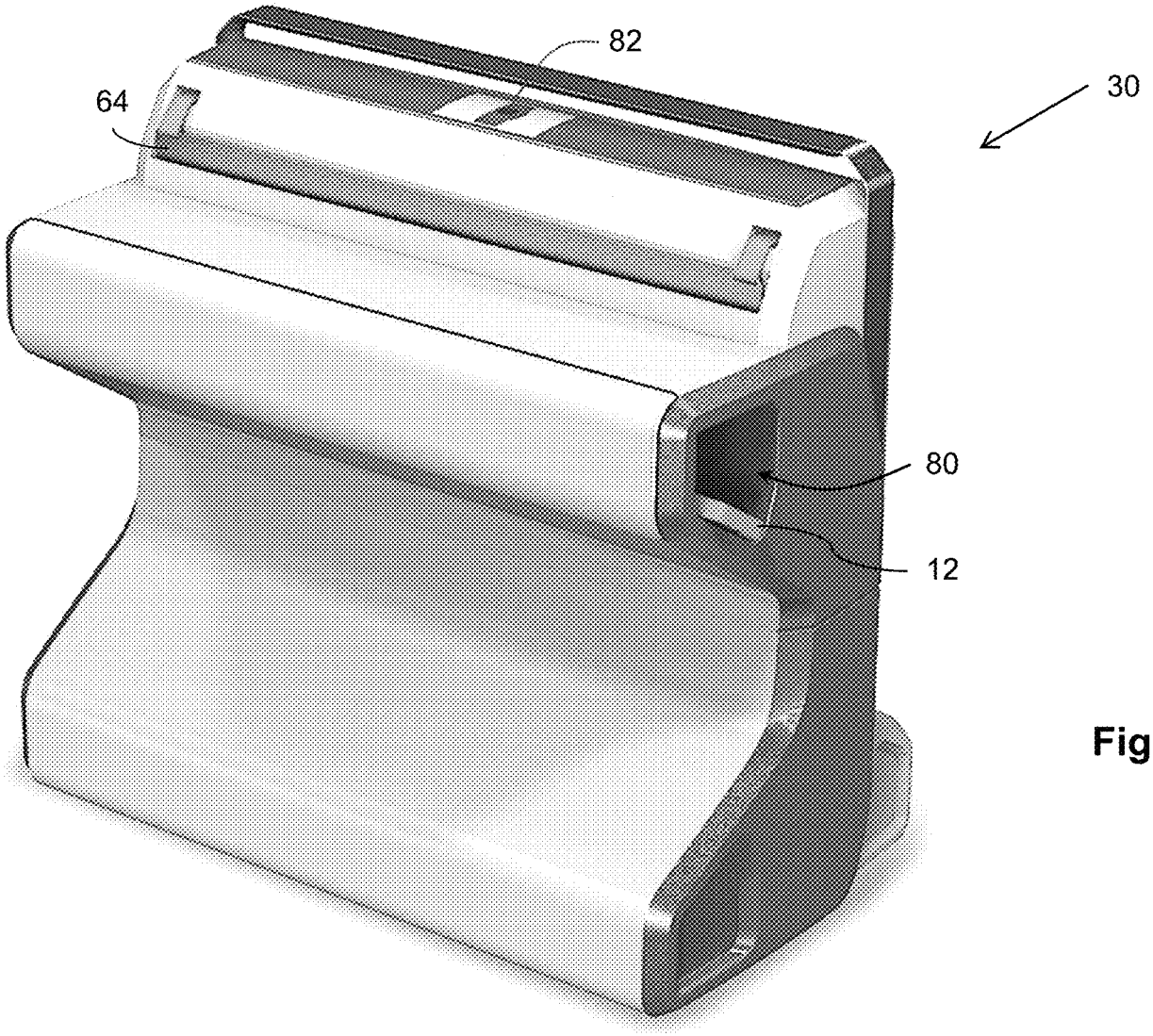
Figure 1K:
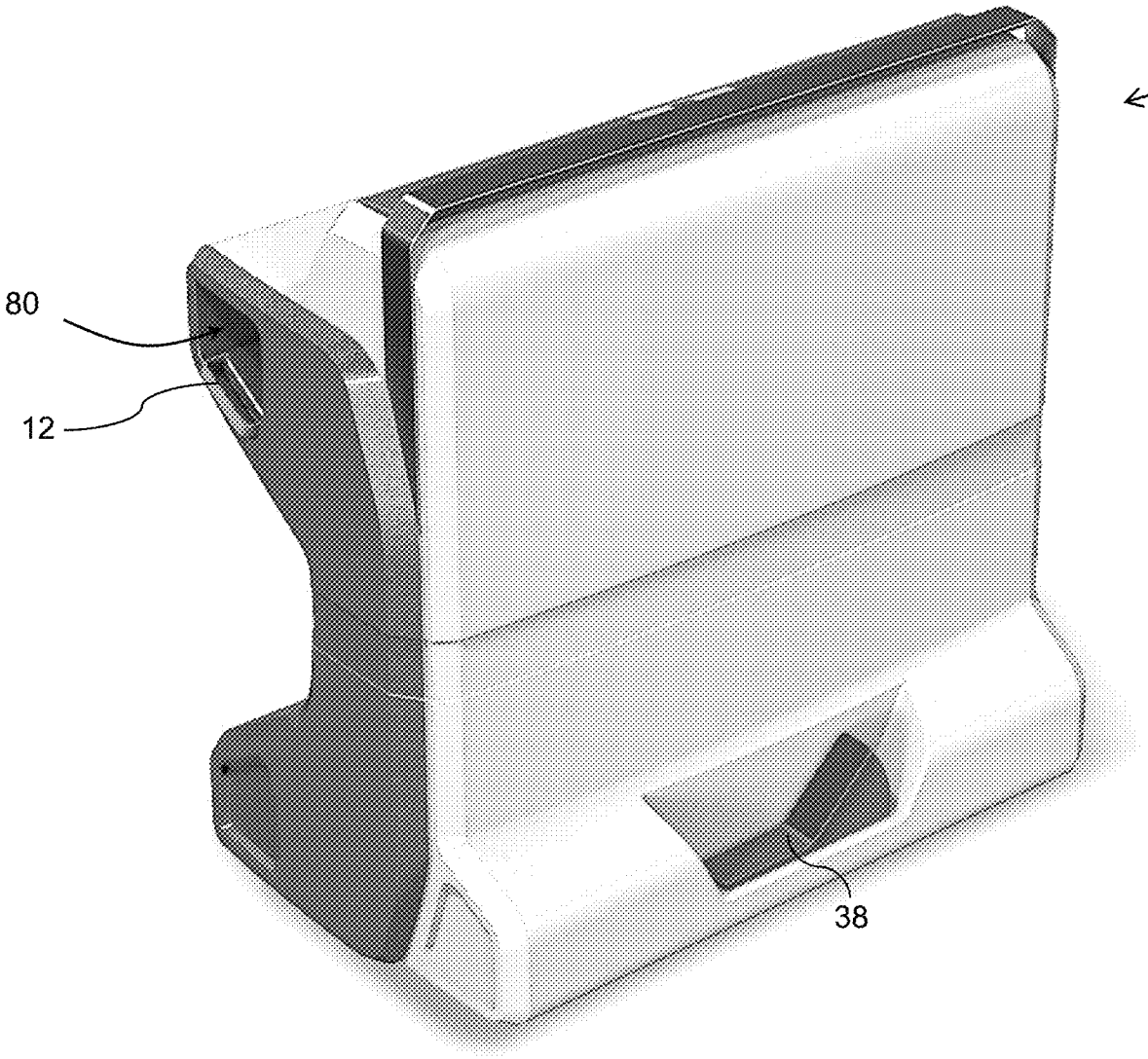

As described in more detail below, the device 30 also includes a bumper assembly 68 that includes a bumper surface 70 for contacting the second resting device, the device to which the patient is to be transferred. As illustrated in FIGS. 1H and 1I, the bumper assembly 68 is disposed on a side of the patient transfer device 30 such that the bumper surface 70 extends from the device 30 at least as far as or farther than a footprint of the bottom assembly 32. Some prior art devices had bases that were generally too big and protruded forward too far. Therefore, the devices could not be wheeled close enough to the second resting device to which the patient is being transferred to be effective. The construction of the device 30 including the respective dimensions and locations of the bottom assembly 32 and the bumper surface 70 addresses these issues. The bumper also distributes the force between the device 30 and the second resting device to which the patient is being transferred to a relatively large area, thus protecting the device 30 and the second resting device. Prior devices, to the extent that they provided any protection for the second resting device, provided protection that was limited in that they did not distribute the force across a large enough surface (force was concentrated on small areas) often resulting in damage to the second resting device.

The power transfer mechanism may also include a spring return mechanism 72 coupled to at least one of the motor 40 and the reels 54. A potential problem with devices such as the device 30 may be that slack on the belts 56 causes the motor 40 or power transfer mechanism, when activated, to "jerk" the patient when picking up slack on the belts 56. This may be uncomfortable to the patient. In the device 30, even prior to activation of the motor 40, the spring return mechanism 72 acts to tighten the belts 56, thus addressing the potential problem. Tightening of the belts 56 (taking up the slack) prior to activation of the motor 40 also eliminates the time spent waiting for the transfer to begin i.e., the time spent waiting for the motor 40 to pick up the slack of the belts 56.

The device 30 also includes an actuator 74 that is connected to the bottom assembly 32 and the top assembly 60 for adjusting the vertical position of the top assembly 60 and thus the pulleys 62 and the pulling force. Vertical adjustment of the pulling force applied to the sheet may be necessary to ensure that the force is substantially horizontal or maybe slightly upwardly inclined to the horizontal to maximize the pulling forces applied to the slide sheet and minimize the creation of turning moment forces. In one embodiment, the actuator 74 may be powered and/or controlled mechanically. In another embodiment, the actuator 74 may be connected to the circuitry in the electric box 50 for the actuator to be powered and/or controlled electronically.

The device 30 also includes an auto-stop mechanism that includes a sensor 66. The auto-stop mechanism shuts off the motor 40 when, as sensed by the sensor 66, the edge of the sheet 12 reaches a predetermined position past the bumper surface 70 corresponding to a full transfer of the patient P.

Figure 1L:
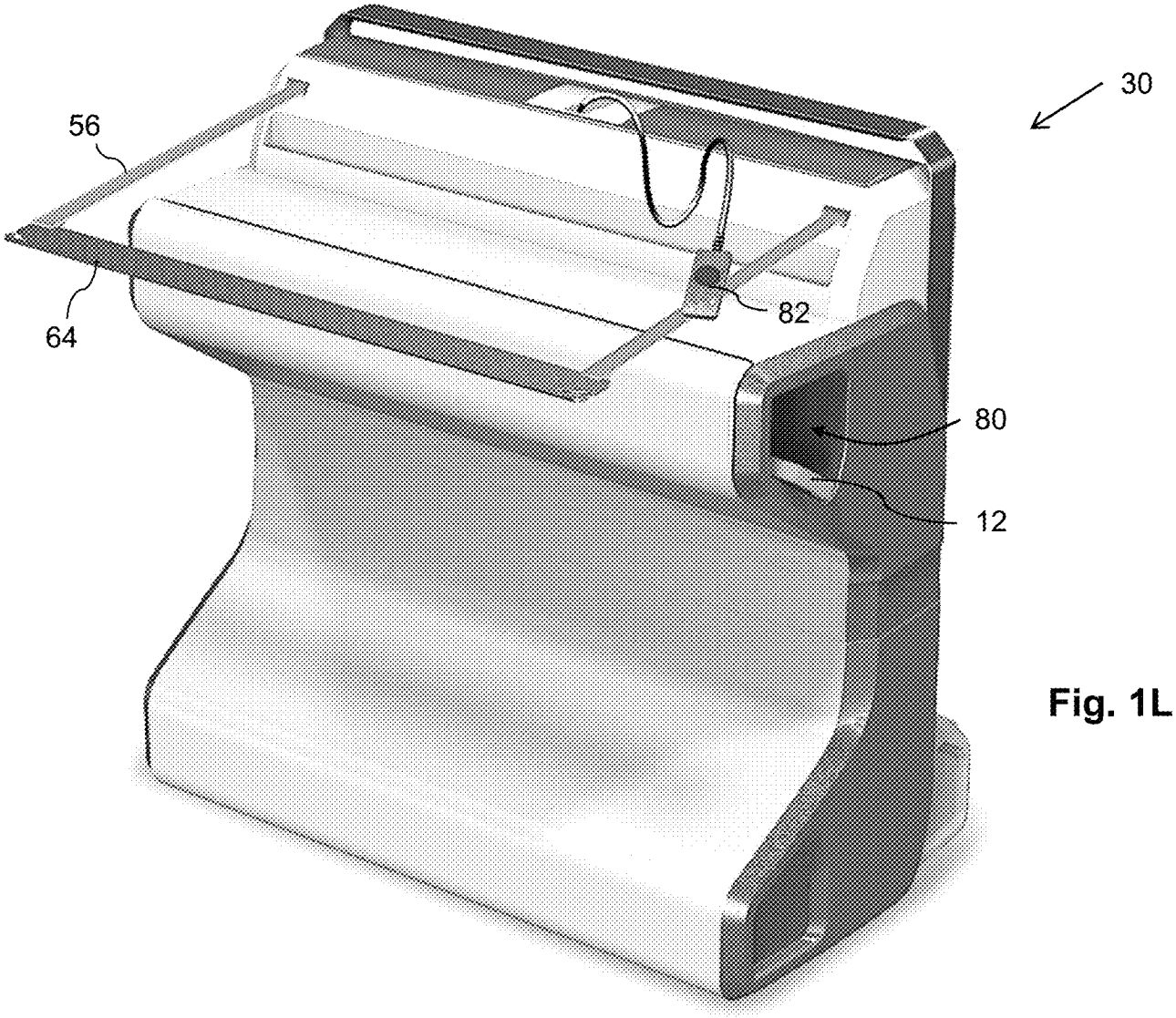
Figure 1M:
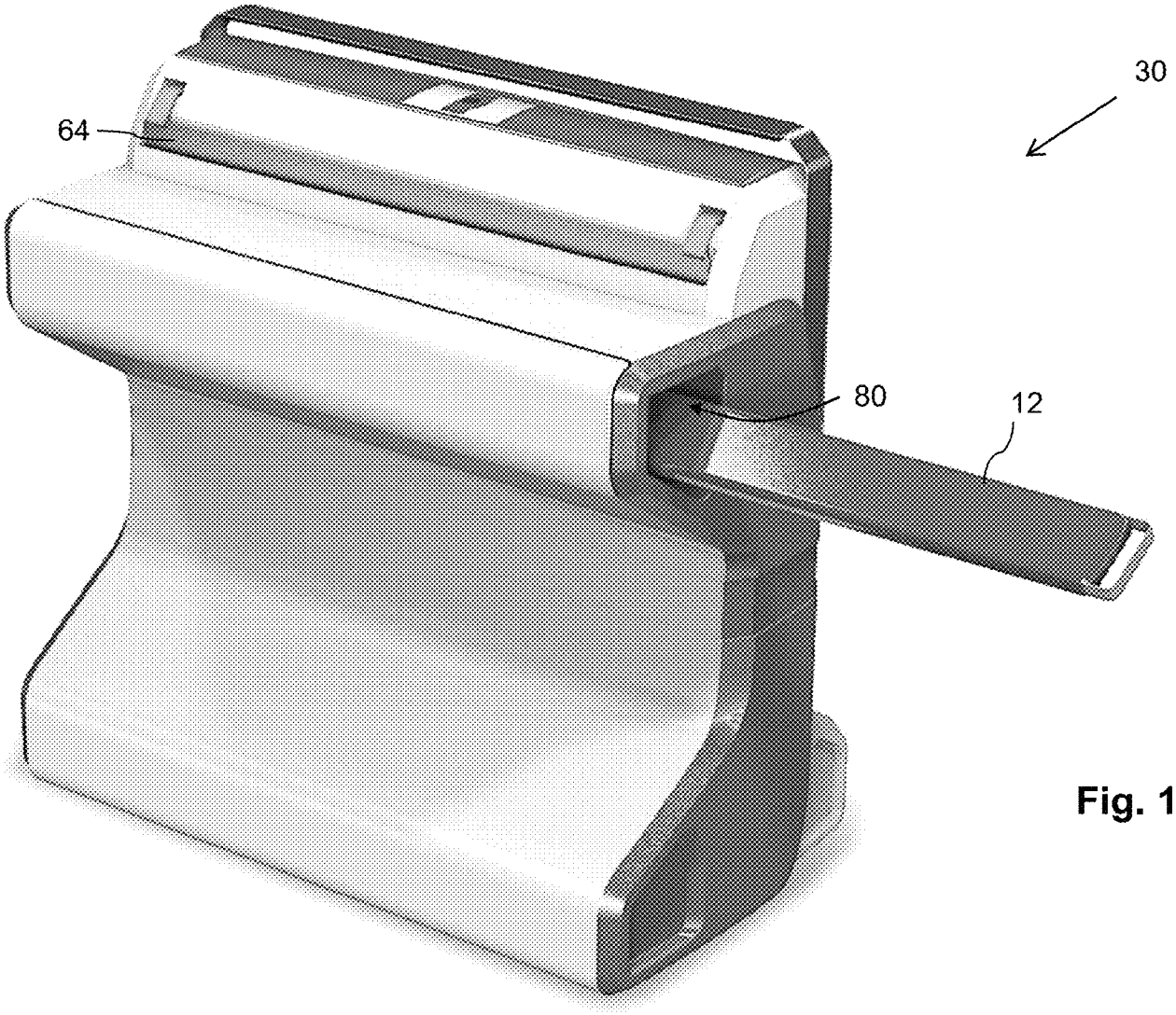

FIGS. 1J-1M illustrate perspective views of the exemplary patient transfer device 30 enclosed in a housing. The housing precludes access to most of the moving parts to prevent damage thereto and to prevent injury to patients and health workers. The device 30 may also include a control 82 as shown in FIG. 1L. The control 82 may include buttons or similar devices such that an operator may control operation of the device 30 including the motor 40, the actuator 74, etc. by operation of the control 82. The housing may also include a pocket 80 for storage of a patient transfer sheet 12.

FIGS. 2A-2D illustrate operation of the patient transfer device 30.

The second resting device D2 is positioned adjacent the first resting device D1. The patient transfer device 30 is then wheeled from the position shown in FIG. 2A to the position shown in FIG. 2B after which the top assembly 60 can be vertically adjusted utilizing the actuator 74. The bumper surface 70 is positioned against the second resting device D2. At this point, the clutch 42 is not engaged and thus the operator may grasp the power transfer bar 64 and easily pull the same to the position shown in FIG. 2B to unwind the belts 56 such that the power transfer bar 64 may engage the sheet 12. Upon the power transfer bar 64 engaging the sheet 12 and the operator letting go of the power transfer bar 64, the spring return mechanism 72 acts to tighten the belts 56.

Figure 2A:
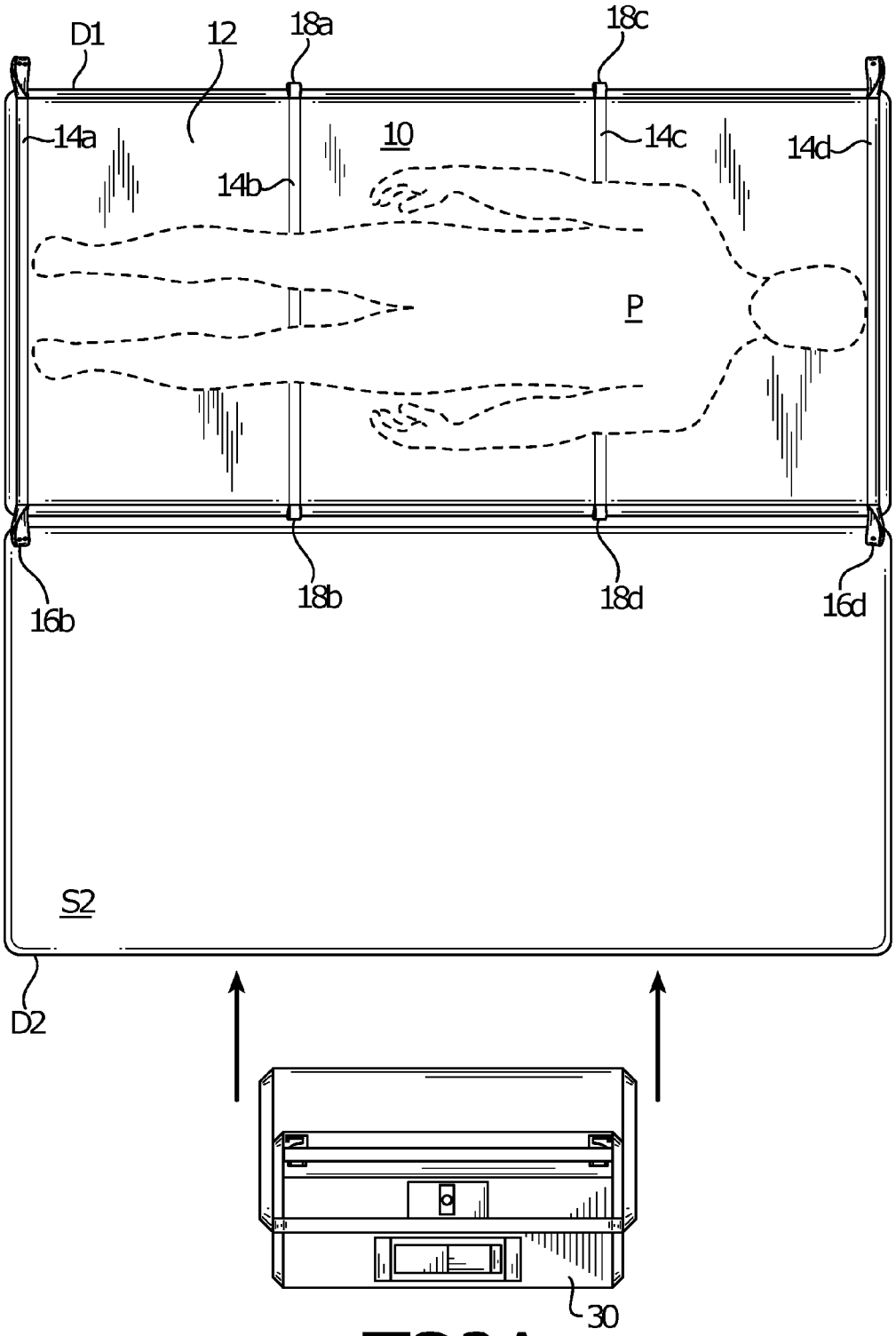
FIGS. 2A-2D illustrate exemplary operation of the patient transfer device.
Figure 2B:
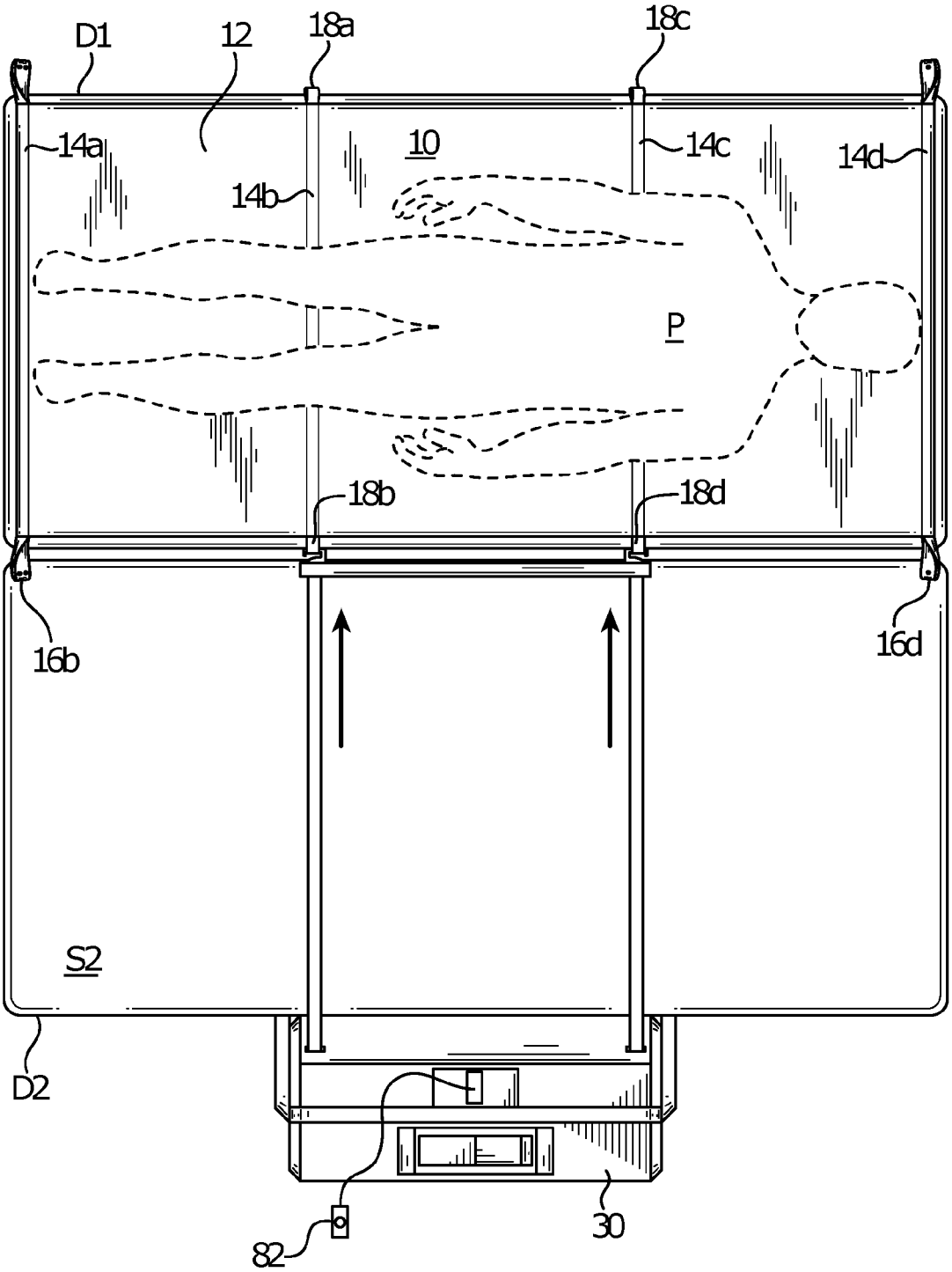
Figure 2C:
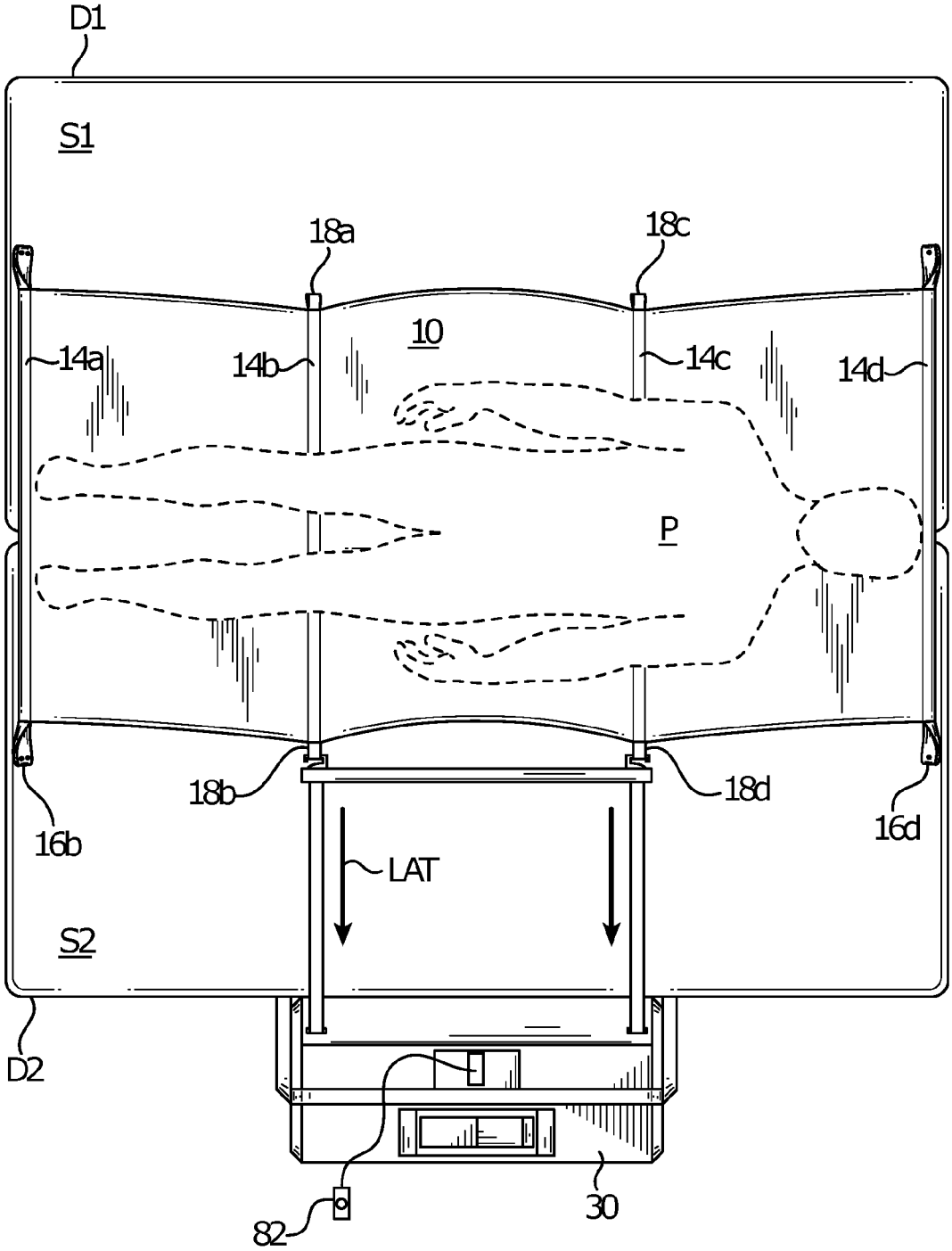
Figure 2D:
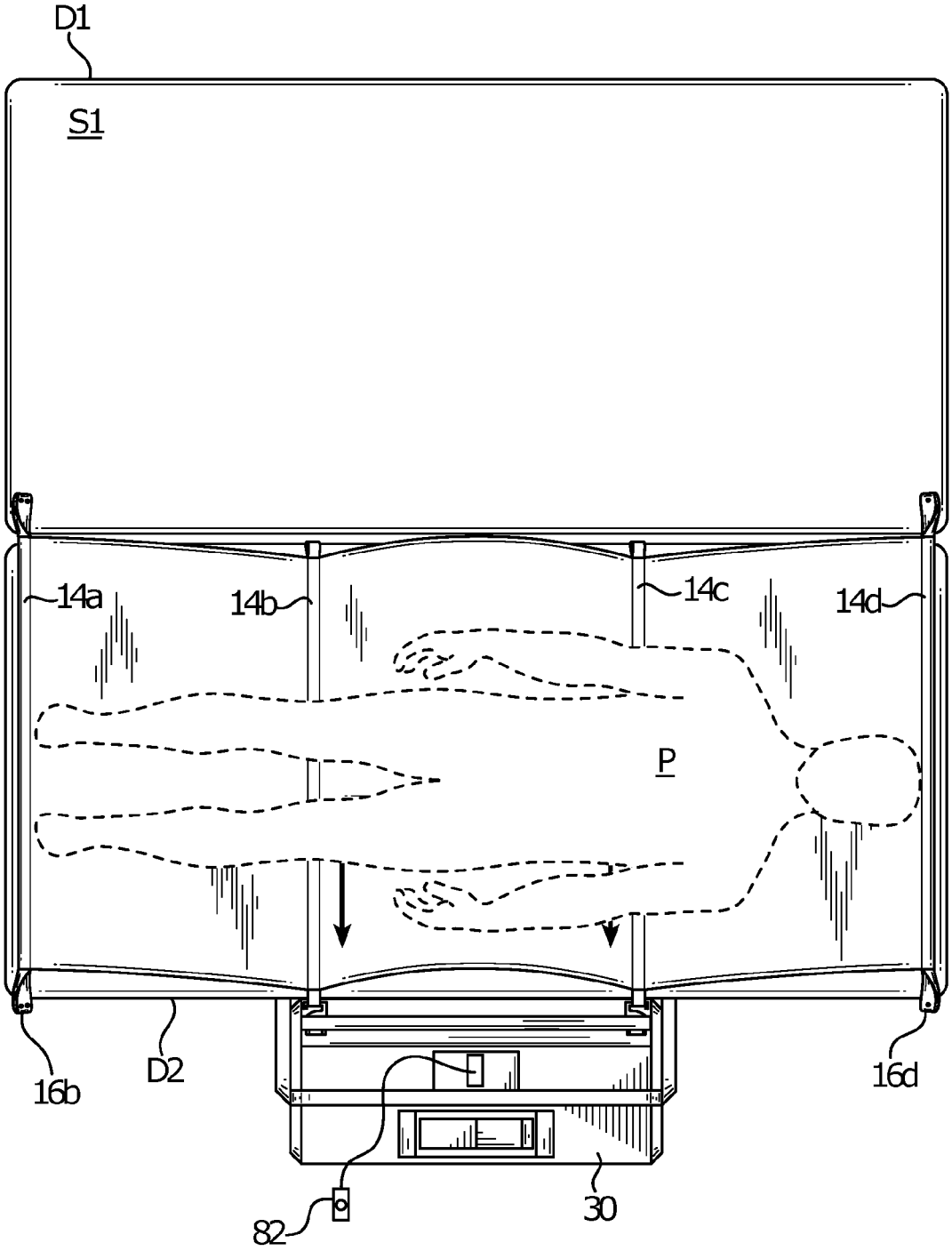

By pressing the correct button on the control 82, the motor 40 is energized. Power is transferred from the motor 40 at the bottom of the patient transfer device 30 to the top of the patient transfer device 30 through the reels 54 and through the pulleys 62 to the sheet 12. Thus, activation of the motor 40 causes the power transfer bar 64 to pull on the sheet 12 for the sheet 12 to slide from the first resting device D1 towards the second resting device D2 while the bumper surface 70 contacts the second resting device D2 thereby transferring the patient P as shown in FIG. 2C. The auto-stop mechanism shuts off the motor when the edge of the sheet 12 reaches a predetermined position past the bumper surface 70 corresponding to a full transfer of the patient P as shown in FIG. 2D.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A patient transfer device for transferring a patient resting on a sheet from a first resting device to a second resting device, the patient transfer device comprising:

a bottom assembly disposed at a bottom portion of the patient transfer device and including wheels or casters for transporting the patient transfer device;

a top assembly disposed at a top portion of the patient transfer device and including pulleys;

a height adjust member connected to the bottom assembly and the top assembly and configured to adjust vertical position of the top assembly and thus the pulleys;

wherein the top assembly includes a bumper assembly including a bumper surface for contacting the second resting device, the bumper assembly disposed on a front side of the patient transfer device such that the bumper surface is disposed on the front side away from the height adjust member at least as far as a footprint of the bottom assembly, vertical position of the bumper surface being adjustable by operation of the height adjust member;

a motor disposed at or adjacent the bottom assembly at the bottom portion of the patient transfer device at an opposite side of the height adjust member from a side of the height adjust member at which the bumper surface is disposed; and a power transfer assembly including a sheet engaging assembly for engaging the sheet, the power transfer assembly in mechanical communication with the motor, the pulleys and the sheet for transferring power from the motor at the bottom of the patient transfer device to the top of the patient transfer device and through the pulleys to the sheet, whereby activation of the motor causes the power transfer assembly to pull on the sheet for the sheet to slide from the first resting device towards the second resting device while the bumper contacts the second resting device thereby transferring the patient.

2. The patient transfer device of claim 1, wherein the power transfer assembly includes:

reels in mechanical communication with the motor; and belts each having at least some portion wound in a respective one of the reels and some portion extending through the pulleys;

wherein the sheet engaging assembly includes:

a power transfer bar at least as long as the distance between two of the pulleys, the power transfer bar operatively connected to the belts and having fasteners for engaging the sheet proximate the power transfer bar.

3. The patient transfer device of claim 1, wherein the power transfer assembly includes:

reels in mechanical communication with the motor;

belts each having at least some portion wound in a respective one of the reels and some portion extending through the pulleys;

a spring return mechanism coupled to at least one of the motor and the reels, wherein, upon the sheet engaging assembly engaging the sheet, the spring return mechanism acts to tighten the belts.

4. The patient transfer device of claim 1, wherein the height adjust member includes an actuator assembly operably connected to the bottom assembly and the top assembly for adjusting the vertical position of the pulleys.

5. The patient transfer device of claim 1, comprising:

a locking mechanism for locking the patient transfer device in place, the locking mechanism including friction locking elements including respective high friction surfaces and extending from the bottom assembly; and a locking pedal operatively connected to the friction locking elements such that operation of the locking pedal causes the high friction surfaces to contact a floor upon which the patient transfer device rests thereby effectively locking the patient transfer device to the floor.

6. The patient transfer device of claim 1, wherein:

activation of the motor causes the power transfer assembly to pull on an edge of the sheet adjacent the sheet engaging assembly to slide the edge past the bumper surface.

7. The patient transfer device of claim 1, wherein:

activation of the motor causes the power transfer assembly to pull on an edge of the sheet adjacent the sheet engaging assembly to slide the edge past the bumper surface, the patient transfer device comprising:

an auto-stop mechanism to shut off the motor when the edge has reached a predetermined position past the bumper surface corresponding to a full transfer of the patient.

8. A patient transfer device for transferring a patient resting on a sheet from a first resting device to a second resting device, the patient transfer device comprising:

a bottom assembly disposed at a bottom portion of the patient transfer device and including wheels or casters for transporting the patient transfer device;

a top assembly disposed at a top portion of the patient transfer device and including pulleys;

a height adjust member connected to the bottom assembly and the top assembly and configured to adjust height of the top assembly;

wherein the top assembly includes a bumper assembly including a bumper surface for contacting the second resting device, the bumper assembly disposed on a front side of the patient transfer device such that the bumper surface is disposed on the front side away from the height adjust member at least as far as a footprint of the bottom assembly, height of the bumper surface being adjustable by operation of the height adjust member;

a motor disposed at or adjacent the bottom assembly at the bottom portion of the patient transfer device at an opposite side of the height adjust member from a side of the height adjust member at which the bumper surface is disposed; and a power transfer assembly including:

reels in mechanical communication with the motor;

belts each having at least some portion wound in a respective one of the reels and some portion extending through the pulleys; and a power transfer bar at least as long as the distance between two of the pulleys, the power transfer bar operatively connected to the belts and having fasteners for engaging the sheet proximate the power transfer bar, whereby activation of the motor causes the power transfer assembly to pull on the sheet for the sheet to slide from the first resting device towards the second resting device thereby transferring the patient.

9. The patient transfer device of claim 8, comprising:

a spring return mechanism coupled to at least one of the motor and the reels, wherein, upon the power transfer bar engaging the sheet, the spring return mechanism acts to tighten the belts.

10. The patient transfer device of claim 8, comprising at least one of:

an actuator assembly operably connected to the bottom assembly and the top assembly for adjusting the vertical position of the pulleys, or a locking mechanism for locking the patient transfer device in place, the locking mechanism including friction locking elements including respective high friction surfaces and extending from the bottom assembly; and a locking pedal operatively connected to the friction locking elements such that operation of the locking pedal causes the high friction surfaces to contact a floor upon which the patient transfer device rests thereby effectively locking the patient transfer device to the floor.

11. The patient transfer device of claim 8, comprising:

a bumper assembly including a bumper surface for contacting the second resting device, the bumper assembly disposed on a side of the patient transfer device such that the bumper surface extends laterally at least as far as a footprint of the bottom assembly.

12. The patient transfer device of claim 8, comprising:

a bumper assembly including a bumper surface for contacting the second resting device, the bumper assembly disposed on a side of the patient transfer device such that the bumper surface extends laterally at least as far as a footprint of the bottom assembly, wherein activation of the motor causes the power transfer assembly to pull on the sheet on an edge adjacent the power transfer bar to slide the edge past the bumper surface.

13. The patient transfer device of claim 8, comprising:

a bumper assembly including a bumper surface for contacting the second resting device, the bumper assembly disposed on a side of the patient transfer device such that the bumper surface extends laterally at least as far as a footprint of the bottom assembly, wherein activation of the motor causes the power transfer assembly to pull on the sheet on an edge adjacent the power transfer bar to slide the edge past the bumper surface; and an auto-stop switch to shut off the motor when the edge has reached a predetermined position past the bumper surface corresponding to a full transfer of the patient.

14. The patient transfer device of claim 8, wherein each of the belts is selected from the group consisting of:

a webbing, an elastomeric belt, a leather belt, a steel reinforced belt, a chain, and a rope.

15. The patient transfer device of claim 8, wherein the fasteners are directly attached to or built on the power transfer bar.

16. A patient transfer device for transferring a patient resting on a sheet from a first resting device to a second resting device, the patient transfer device comprising:

a bottom assembly disposed at a bottom portion of the patient transfer device and including wheels or casters for transporting the patient transfer device;

a top assembly disposed at a top portion of the patient transfer device and including pulleys;

a height adjust member connected to the bottom assembly and the top assembly and configured to adjust vertical position of the top assembly and thus the pulleys;

wherein the top assembly includes a bumper assembly including a bumper surface for contacting the second resting device, the bumper assembly disposed on a front side of the patient transfer device such that the bumper surface is disposed on the front side away from the height adjust member at least as far as a footprint of the bottom assembly, vertical position of the bumper surface being adjustable by operation of the height adjust member;

a motor disposed at or adjacent the bottom assembly at the bottom portion of the patient transfer device at an opposite side of the height adjust member from a side of the height adjust member at which the bumper surface is disposed;

reels in mechanical communication with the motor;

a spring return mechanism coupled to at least one of the motor and the reels;

belts each having at least some portion wound in a respective one of the reels and some portion extending through the pulleys; and a sheet engaging assembly operatively connected to the belts and the sheet, the sheet engaging assembly including a power transfer bar operatively connected to the belts and having fasteners for engaging the sheet proximate the power transfer bar;

wherein, upon the fasteners of the sheet engaging assembly engaging the sheet, the spring return mechanism acts to tighten the belts, and wherein subsequent activation of the motor causes the reels to wind a portion of the belts thereby transferring power from the motor at the bottom of the patient transfer device to the top of the patient transfer device and through the pulleys to the sheet engaging assembly and to the sheet for the sheet to slide from the first resting device towards the second resting device thereby transferring the patient.

17. The patient transfer device of claim 16, comprising at least one of:

an actuator assembly operably connected to the bottom assembly and the top assembly for adjusting the vertical position of the pulleys, or a locking mechanism for locking the patient transfer device in place, the locking mechanism including friction locking elements including respective high friction surfaces and extending from the bottom assembly; and a locking pedal operatively connected to the friction locking elements such that operation of the locking pedal causes the high friction surfaces to contact a floor upon which the patient transfer device rests thereby effectively locking the patient transfer device to the floor.

18. The patient transfer device of claim 16, wherein activation of the motor causes an edge of the sheet, the edge adjacent the sheet engaging assembly, to slide past the bumper surface.

19. The patient transfer device of claim 16, comprising:

an auto-stop switch to shut off the motor when the edge has reached a predetermined position past the bumper surface corresponding to a full transfer of the patient.

20. The patient transfer device of claim 16, wherein the fasteners and the power transfer bar are unitary.

* * * * *